US005253958A

United States Patent [19]

Bellemare

[11] Patent Number: 5,253,958

[45] Date of Patent: Oct. 19, 1993

[54] DEVICE FOR DRIVING A STAKE INTO THE GROUND

[76] Inventor: Serge Bellemare, 3248 Hochelaga, Montrëal, Qc, Canada, H1W 1G6

[21] Appl. No.: 14,764

[22] Filed: Feb. 8, 1993

[51] Int. Cl.[5] ..... E02D 7/20; E02D 27/48

[52] U.S. Cl. ..... 405/232; 405/230

[58] Field of Search ..... 405/228, 229, 230, 232; 173/19, 90, 91

[56] References Cited

U.S. PATENT DOCUMENTS

| | | | |
|---|---|---|---|
| 2,798,363 | 7/1957 | Hazak et al. | 61/76 |
| 3,056,477 | 10/1962 | Wooley | 189/92 |
| 3,763,654 | 10/1973 | Matsushita | 405/232 |
| 3,902,326 | 9/1975 | Langenbach, Jr. | 61/51 |
| 4,257,488 | 3/1981 | Schnell | 405/232 X |
| 4,357,994 | 11/1982 | Hall | 187/17 |
| 4,665,994 | 5/1987 | Snider | 173/90 |
| 4,765,777 | 8/1988 | Gregory | 405/230 |
| 4,925,345 | 5/1990 | McCown, Jr. et al. | 405/232 |
| 4,974,997 | 12/1990 | Sero et al. | 405/231 |
| 5,120,163 | 6/1992 | Holdeman et al. | 405/230 |

*Primary Examiner*—David H. Corbin
*Attorney, Agent, or Firm*—Merchant & Gould, Smith, Edell, Welter & Schmidt

[57] ABSTRACT

A device for driving a stake into the ground, particularly a foundation stake of new or existing buildings. The device may also be used for stabilizing, raising and shoring foundations, or for any other similar application. The device has two hydraulic jacks on which are secured two rods, the hydraulic jacks and the rods being parallel to the driving axis of the stake. The device has also a driving member provided with a hammering head continuously in contact with the upper end of the stake during the power stroke of the hydraulic jacks Bores are provided in the hammering head in which the rods are inserted. Latches facing each other are provided in the hammering head to prevent segments of larger diameter on the rods from going through the bore during the return stroke but not during the power stroke, therefore allowing the stake to be driven by the hammering head during the return stroke.

7 Claims, 4 Drawing Sheets

DEVICE FOR DRIVING A STAKE INTO THE GROUND

FIELD OF THE INVENTION

The present invention relates to a device for driving a stake into the ground, particularly a foundation stake of new or existing buildings. The device may also be used for stabilizing, raising and shoring foundations, or for any other similar application.

DESCRIPTION OF PRIOR ART

Foundation stakes are widely used to give support to buildings. They consist of an elongated rod, beam or pile driven into the ground until they reach the bedrock or an underground strata able to give a suitable load-bearing.

The stakes are usually driven by appropriate devices depending on the size of the stakes and the depth they need to reach. In the case of long and large stakes, such as the stakes of large buildings, they are hammered down with a driving hammer Although such hammering devices are useful for a range of applications, it is not necessarily the most suitable choice for small buildings, such as a common house, because of the noise and vibrations generated by the impact of the ram on the stake which may cause damages to surrounding structures or buildings. Since such devices are also bulky and provided with a heavy ram, it is very difficult to use them in small or remote spaces. Example of a driving hammer for driving foundation stakes is disclosed in U.S. Pat. No. 2,798,363.

Yet, when the soil conditions below an existing building changes or the geologic expertise of the ground were not accurate, the building may experience damages, such as cracks and fissures throughout the whole building, due to the settling of its foundation. The solution to such a problem is the stabilizing and shoring of the foundation and, if necessary, the raising of the foundation prior to the shoring.

Among the references about devices and methods of shoring a foundation, some are using driven stakes, like in U.S. Pat. Nos. 3,902,326 and 4,925,345 which use the force generated by one or two hydraulic jacks and which are secured to the foundation. When a stake is driven into the subsoil below the foundation and it has reached the bedrock or a load-bearing underground strata, the foundation can be raised by applying a force on the stake until the foundation goes up to substantially its original level. In U.S. Pat. No. 4,925,345, the device has two hydraulic jacks parallel to the stake and the driven force is applied on the stake by means of clamping wedges. Those clamping wedges are not well adapted because they have to be repositioned by hand after each stroke.

In U.S. Pat. No. 3,902,326, the device has a single hydraulic jack located and aligned with the stake to be driven for applying the driven force directly over the stake. Stake sections are provided to allow the stake to be driven farther into the subsoil than the stroke of the piston. This device is however not simple because pile sections have to be installed after each stroke.

The main drawback o the prior art devices is that they require a manipulation after each stroke of the hydraulic jack or jacks. To minimize the number of manipulations, the hydraulic jacks have to be as long as possible.

The object of the present invention is to provide a device to drive stakes into the ground that is simple and which requires no manipulation between the strokes until the post is at a suitable level

SUMMARY OF THE INVENTION

More particularly, there is provided a device for driving a stake into the ground, the stake being driven along a driving axis, the device comprising:

- a main frame having attaching means for securing the main frame to an inertial massive base;
- a driving member having a hammering head for driving the stake;
- jack means extending parallel to the driving axis and having a first portion intended to be secured to the main frame and a second portion which is mobile with respect to the first portion, the jack means having a power stroke and a return stroke;
- at least two rods extending parallel to the driving axis, each of the rods having an end which is solid with the second portion of the jack means, the rods extending respectively through bores provided in the driving member, the rods being provided at predetermined distances along their length with at least two pairs of segments secured thereon, the segments having a diameter larger than a diameter of the rods and being able to go through the bores;
- two gate means disposed onto the driving member, respectively around the bores, the gate means allowing the segments to go through the bores during the return stroke and preventing the segment from going through the bores during the power stroke to move the hammering head against the stake; and
- guiding means attached onto the second portion of the jack means and having a bore to receive the stake so that the stake be substantially kept coaxial to the driving axis during the return and power strokes, whereby the device drives the stake into the ground as the hammering head is moved against the stake during the power stroke.

According to a preferred embodiment of the invention, the jack means comprise two hydraulic jacks symmetrically disposed about the driving axis.

According to another preferred embodiment of the invention, each of the gate means comprise two latches facing each other and disposed around the corresponding bore of the driving member, each of the latches including a first end pivotally attached to the driving member and a second end moving between a position substantially parallel to the driving member and a position substantially perpendicular to the driving member, whereby the gate means prevent the segments from going through the bores during the power stroke and allow the segment to go through the bores during the return stroke.

According to a still preferred embodiment of the invention, the inertial massive base is a building foundation, the main frame comprising a L-shaped bracket having a portion intended to be fitted under a wall of the building foundation.

A non restrictive description of a preferred embodiment will now be given with reference to the appended drawings.

DESCRIPTION OF A PREFERRED EMBODIMENT

Figure 1:
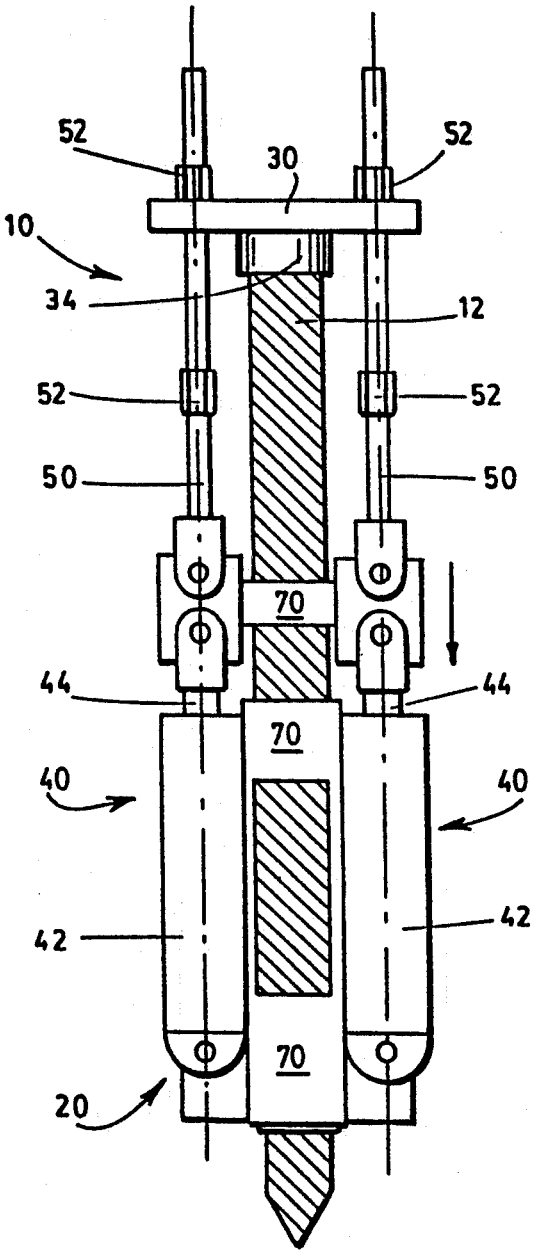
FIG. 1 is an elevational view of the device during a first operating position thereof, according to the invention.
Figure 2:
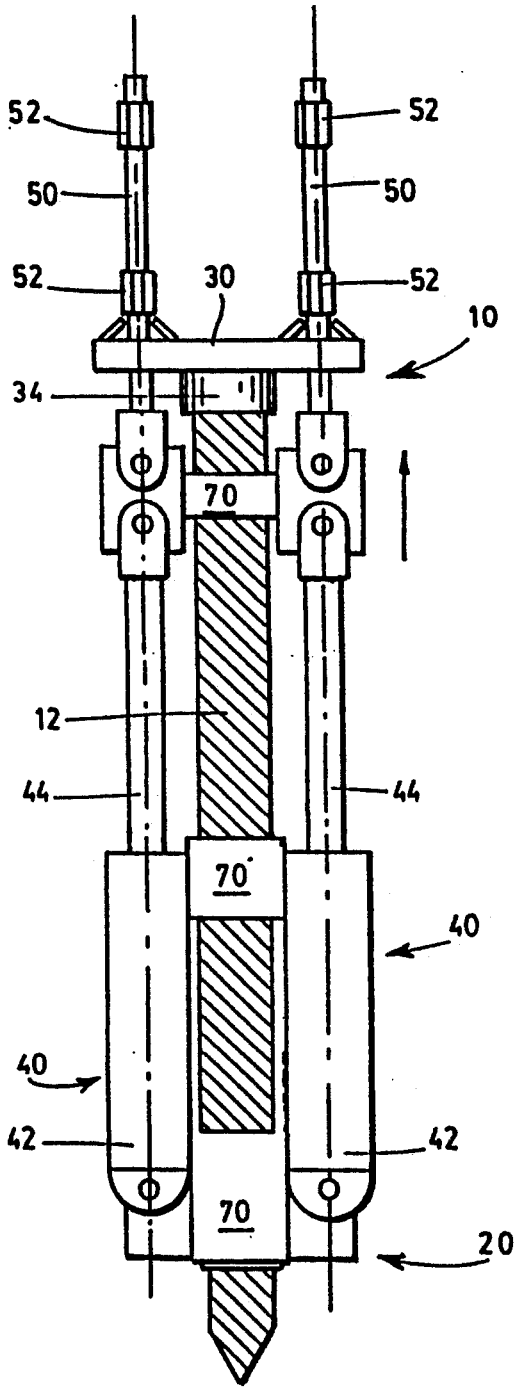
FIG. 2 is an elevational view of the device shown in FIG. 1, during a second operating position thereof.
Figure 5:
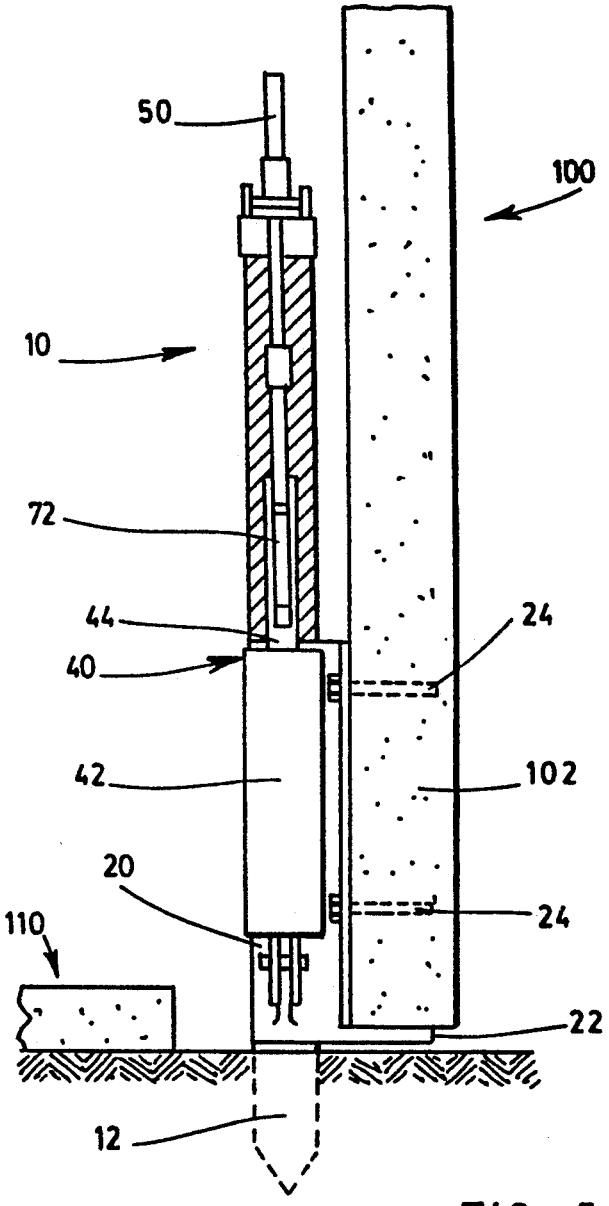
FIG. 5 is a side elevational view of the device when it is to a wall.

Referring now to FIGS. 1, 2 and 5, the device 10 is used to drive a stake 12 along a driving axis coaxial with the central axis of the stake 12. The stake 12 is usually made of steel.

Figure 6:
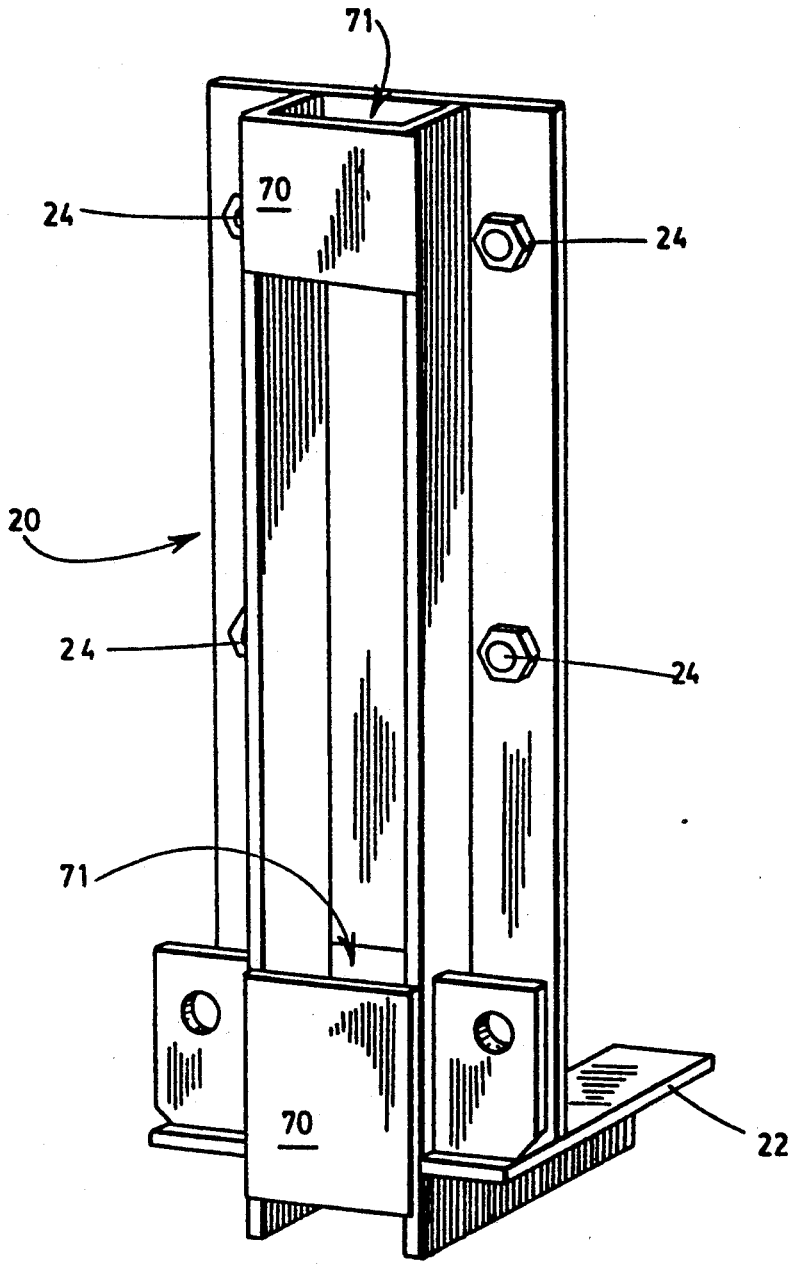
FIG. 6 is a perspective view of a portion of the device.

The device 10 comprises a main frame 20 forming an L-shaped bracket as shown in FIG. 6, for securing the main frame 20 to an inertial massive base. Preferably, the bracket has a lower portion 22 intended to be fitted under a wall of a building foundation 100. Bolts 24 may also be provided to secure the main frame 20 very solidly onto the wall.

The inertial massive base is a building foundation 100 and the L-shaped bracket may have a portion 22 thereof intended to be fitted under a wall 102 of the building foundation 100. The inertial massive base may also be a heavy object such as a truck, a big rock or a concrete block. This allows the device 10 to be used for driving foundation stakes of a new building.

The device 10 includes a driving member 30, having a hammering head 34 for driving the stake 12. The hammering head 34 has a central bore in which the end of the stake 12 is inserted. The bore prevents the end of the stake 12 from moving outside thereof when the stake 12 is driven. A screw 35 applying a side pressure on the end of the stake 12 helps to keep it in the central bore. It also allows the hammering head 34 to be constantly against the stake 12, especially during the return stroke described hereinafter Jack means, such as two hydraulic jacks 40 symmetrically disposed about the driving axis, extend parallel therefrom. Each hydraulic jack 40 has a first portion, such as the cylinder 42, secured to the main frame 20 and a second portion, such as the piston rod 44, which is mobile with respect to the cylinder 42. Of course, alternately, the first portion may also be the piston rod and the second portion may be the cylinder.

The hydraulic jack 40 has a power stroke and a return stroke, said jack being controlled by pressurized oil.

As shown in FIGS. 1 and 2, there are also provided two rods 50 extending parallel to the driving axis. Each of the rods 50 has an end which is solid with the piston rod 44 of the hydraulic jack 40. The connection is made by a sliding guide 72 movable along the stake 12 which is part of the guiding means. The sliding guide 72 is advantageously between the piston rods 44 and the rods 50 so as to make a junction thereof.

Figure 3:
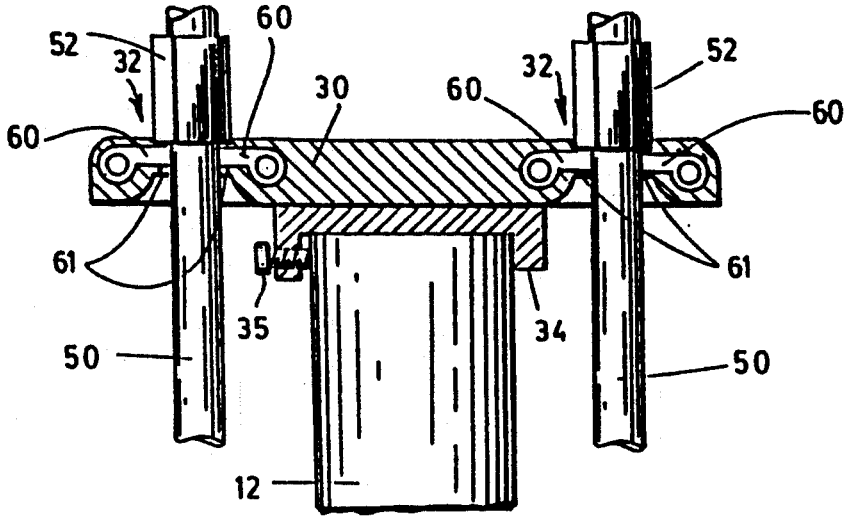
FIG. 3 is a partial cross-sectional view of a portion of the device shown in FIG. 1.
Figure 4:
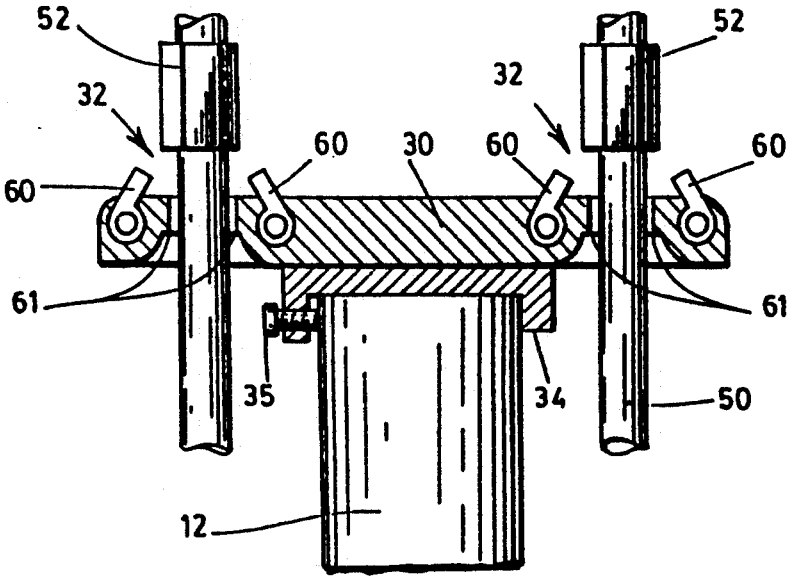
FIG. 4 is a cross-sectional view of a portion of the device shown in FIG. 2.

The rods 50 extend respectively through bores 32 shown in FIGS. 3 and 4, provided in the driving member 30. The rods 50 are provided, at predetermined distances along their length, with at least two pairs of segments 52 secured thereon. The segments B2 have a diameter larger than a diameter of the rods 50, but the bores 32 have a diameter allowing the segments 52 to go through them.

The segments 52, preferably provided on the rods at substantially the same level along the length thereof, may be nuts disposed along the rods 50 which are threaded.

Referring now to FIGS. 3 and 4, two gate means are disposed onto the driving member, respectively around the bores 32, to allow the segments 52 to go through the bores 32 during the return stroke and preventing them from going through the bores 32 during the power stroke. This will allow to move the hammering head 34 against the stake 12 to drive it during the power stroke and to reset the hydraulic jacks 40 during the return stroke since the stake 12 has moved into the ground.

The gate means comprise two latches 60 facing each other and disposed around the corresponding bore 32. Each of the latches 60 includes a first end pivotally attached to the driving member 30. The second end of the latches 60 can pivot upwards from a first position where the second end rests substantially horizontally against the stoppers 61 to partially block the corresponding bore 32, to a second upper position where the corresponding bore 32 is free. As aforesaid, the latches 60 will prevent the segments 52 from going through the bores 32 during the power stroke and allow the segment to go through the bores during the return stroke.

To make sure the stake 12 remains in the correct position, guiding members 70 are provided. They have a central bore 71 shown in FIG. 6, are provided to receive the stake 12 so that the stake 12 is substantially kept coaxial to the driving axis during the return and power strokes.

Referring now to FIG. 6, it can be seen that the main frame 22 forms an L-shaped bracket having the lower portion 22 intended to be fitted under the wall 102 of the foundation 100 shown in FIG. 5.

In use, the stake 12 is mounted in the device 10 and then it is set to its power stroke. Initially, the rods 50 are set at a maximum length so that their upper segments 52 are used to move the driving member because the stake 12 is fully outside the ground.

During the power stroke, the stake 12 is pushed in the ground because the latches 60 are preventing the segments 52 from going through the bores 32, as shown in FIG. 3.

When the power strokes of the piston rods 44 are substantially completed, the device 10 has to be reset in order to drive the stake 12 further into the ground. This is done during the return stroke where additional lower segments 52 get through the bores 32 until the piston rods are in position to perform another power stroke to drive the stake further into the ground. During the return stroke, the latches 60 are pivoted upwards to allow passage of those segments 62. Once those segments have got through the bores, they will not be able to move back through the bores 32 again. The driving member 30 remains in place by gravity or by another suitable means allowing the hammering head to stay in contact with the end of the stake 12 continuously. After the end of the reset, the hydraulic jacks 40 then change to the power stroke and the process continues until the stake is sufficiently solid in the ground, such as when the stake 12 reaches a bedrock.

If the bedrock is very deep or if the stakes 12 are short, the device 10 can be reset up and another stake 12 or an extension thereof (not shown) can be abutted on the driven stake to push it further down. This can be done as many times as needed.

As aforesaid, the device 10 may also be suitable for stabilizing and raising foundations. This can be achieved by allowing the end of the stake 12 to rest on a bedrock or an underground supporting strata. By trying to push the stake 12 further in the ground, an opposite force will then be generated in the foundation and that opposite force will eventually stabilize and raise the foundation.

When the bedrock is reached, the upper portion of the stake 12 is cut at the level of the upper portion of the main frame. Of course, the stake 12 does not have to be cut if the stake 12 has been fully driven by the device 10 itself and is already at a suitable level.

When stabilizing, raising and shoring foundations, the stake 12 is then welded to the main frame 20 to rigidly attach it thereon. Since the main frame 20 is intended to be permanently in place, it will be the link between the building and the stake 12. If necessary, some parts of the main frame 20 can be removed to minimize the space taken to hold the stake 12.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

I claim:

1. A device for driving a stake into the ground, said stake being driven along a driving axis, said device comprising:

a main frame having attaching means for securing said main frame to an inertial massive base;

a driving member having a hammering head for driving said stake;

jack means extending parallel to said driving axis and having a first portion intended to be secured to said main frame and a second portion which is mobile with respect to said first portion, said jack means having a power stroke and a return stroke;

at least two rods extending parallel to said driving axis, each of said rods having an end which is solid with said second portion of said jack means, said rods extending respectively through bores provided in said driving member, said rods being provided at predetermined distances along their length with at least two pairs of segments secured thereon, said segments having a diameter larger than a diameter of said rods and being able to go through said bores;

two gate means disposed onto said driving member, respectively around said bores, said gate means allowing said segments to go through said bores during said return stroke and preventing said segment from going through said bores during said power stroke to move said hammering head against said stake; and guiding means attached onto said second portion of said jack means and having a bore to receive said stake so that said stake be substantially kept coaxial to said driving axis during said return and power strokes, whereby said device drives said stake into the ground as said hammering head is moved against said stake during said power stroke.

2. The device according to claim 1, wherein said jack means comprise two hydraulic jacks symmetrically disposed about said driving axis.

3. The device according to claim 1, wherein each of said gate means comprise two latches facing each other and disposed around the corresponding bore of said driving member, and two stoppers cooperating with the corresponding latches, each of said latches including a first end pivotally attached to said driving member and a second end pivoting upwards from a first position where said second end rests substantially horizontally against the corresponding stopper to partially block the corresponding bore, to a second upper position where the corresponding bore is free, whereby said gate means prevent said segments from going through said bores during the power stroke and allow said segment to go through said bores during said return stroke.

4. The device according to claim 1, wherein said inertial massive base is a building foundation, said main frame comprising an L-shaped bracket having a lower portion intended to be fitted under a wall of said building foundation.

5. The device according to claim 2, wherein each of said gate means comprise two latches facing each other and disposed around the corresponding bore of said driving member, and two stoppers cooperating with the corresponding latches, each of said latches including a first end pivotally attached to said driving member and a second end pivoting upwards from a first position where said second end rests substantially horizontally against the corresponding stopper to partially block the corresponding bore, to a second upper position where the corresponding bore is free, whereby said gate means prevent said segments from going through said bores during the power stroke and allow said segment to go through said bores during said return stroke.

6. The device according to claim 2, wherein said inertial massive base is a building foundation, said main frame comprising an L-shaped bracket having a lower portion intended to be fitted under a wall of said building foundation.

7. The device according to claim 3, wherein said inertial massive base is a building foundation, said main frame comprising an L-shaped bracket having a lower portion intended to be fitted under a wall of said building foundation.

* * * * *